United States Patent [19]

Bauer et al.

[11] Patent Number: 4,791,758

[45] Date of Patent: Dec. 20, 1988

[54] EXPANDABLE PREHANGABLE SPLIT DOOR FRAME

[75] Inventors: Gunther H. Bauer, Port Coquitlam; David J. Buck, Delta, both of Canada

[73] Assignee: Windor Manufacturing Ltd., Port Coquitlam, Canada

[21] Appl. No.: 78,532

[22] Filed: Jul. 28, 1987

[51] Int. Cl.[4] ..... E06B 1/04

[52] U.S. Cl. ..... 49/505; 52/212

[58] Field of Search ..... 49/505; 52/217, 212

[56] References Cited

U.S. PATENT DOCUMENTS

| | | | |
|---|---|---|---|
| 3,420,003 | 1/1969 | Cline | 49/505 |
| 3,571,995 | 3/1971 | Kasprzak | 52/217 X |
| 3,808,759 | 5/1974 | Carmichael | 52/212 |
| 4,395,855 | 8/1983 | Juker | 49/505 X |

FOREIGN PATENT DOCUMENTS

| | | | |
|---|---|---|---|
| 1054664 | 1/1967 | United Kingdom | 49/505 |

OTHER PUBLICATIONS

"Adjusta-Fit" Brochure of General Products Co., Inc. Fredericksburg, VA.

Brochure of the Ceco Corporation, Oak Brock, Ill.

"Adjusta-A-Frame" Brochure of the Kewanee Corporation, Kewanee, Ill.

*Primary Examiner*—Philip C. Kannan

*Attorney, Agent, or Firm*—Pretty, Schroeder, Brueggemann & Clark

[57] ABSTRACT

A door frame having a hinged jamb, a strike jamb and a header, each of which is in two parts. One part of each pair has a channel for slidably receiving a lipped segment of the other part. A lipped cover on the first part engages the lipped segment of the second part to limit movement of the two parts relative to one another. A biasing means on the first part urges the two parts against one another. The biasing means is rigidly affixed to the first part and extends across the channel to leave a small gap through which the lipped segment of the first part can be rotatably inserted.

6 Claims, 3 Drawing Sheets

EXPANDABLE PREHANGABLE SPLIT DOOR FRAME

FIELD OF THE INVENTION

This application pertains to expandable premanufactured door frames which can be adjusted to fit walls of varying thicknesses.

BACKGROUND OF THE INVENTION

Pre-manufactured door frames are used extensively in construction because they can be rapidly manufactured in large volumes to consistently high quality standards and close tolerances, thus significantly reducing the time and cost of job-site labour that would be required if a craftsman had to manufacture a custom door frame. Pre-manufactured door frames can be quickly and easily installed in a wood framed door aperture or in a masonry door opening by relatively unskilled persons with simple tools to yield a finished door frame of professional quality and appearance.

Because the walls in which wood framed door apertures or masonry door openings are situate can be of varying thicknesses, pre-manufactured door frames are sometimes constructed so that they may be adjusted to fit a range of wall thicknesses. Conventionally, premanufactured adjustable door frames have six major parts; namely, a two part strike jamb assembly, a two part hinge jamb assembly, and a two part header assembly. One part of each pair is ordinarily provided with a slotted groove or channel member which slidably receives a mating tongue or channel member of the other part. To assemble the door frame a workman fits the three grooved parts into position on one side of the door aperture and fastens them in place. The other three parts are then slid into position from the opposite side of the door aperture so that the aforementioned tongues or channel members are slidably received within the cooperating grooves or channel members in the first parts. The tongued (or channelled) parts are slidably positioned as aforesaid until their outer flanges are flush with the wall and the tongued (or channelled) parts are then also fastened to the wall to complete the door frame.

Tongue and groove type expandable door frames suffer at least two disadvantages. First, they can only be adjusted to accomodate a relatively small variation in wall thickness (typically about ½ inch). Accordingly, manufacturers of such door frames have had to provide a range of six or more models merely to accomodate wall thicknesses varying from about four to seven inches. This requires the manufacturer to schedule production volumes carefully, maintain increased product inventory and check customer orders carefully. The customer must in turn carefully determine the size of door frame required to fit each of the door apertures in a particular building and ensure that the correct door frame model is ordered for each aperture.

Expandable door frames constructed with channel members are capable of accomodating somewhat greater wall thickness variation than tongue and groove type expandable door frames, but it can be difficult and time consuming to align the channel members so that the door frame parts can be slid into position.

The second disadvantage of tongue and groove type expandable door frames is that the tongue and groove interlock is relatively flimsy and can in some cases cause misalignment of the door frame.

The present invention provides a pre-manufactured expandable door frame which overcomes the foregoing disadvantages. More particularly, expandable door frames constructed in accordance with the invention are of extremely rigid construction and may be adjusted to accomodate wall thickness variations of about two and one quarter inches or more, thus affording manufacturers the significant advantage of focusing their manufacturing, inventory and ordering on a single door frame model adapted to suit the widest possible range of customer needs. A further significant advantage of the preferred embodiment is that it may be prehung with a door at the factory.

SUMMARY OF THE INVENION

The invention provides a door frame comprising a hinge jamb, a strike jamb and a header; each of which in turn comprises a pair of first and second members. The first member of each pair has a channel for slidably receiving a lipped segment of the second member of that pair. The channel has a lipped cover for engaging the lipped segment to limit movement of the two members of each pair relative to one another without connection between the members fo each pair.

Each pair of members includes a biasing means for urging the two members of each pair against one another. The biasing means may advantageously comprise a third member rigidly affixed to the first member of each pair and extending across the channel thereof to leave a small gap between the third member and the lipped cover of the first member. The lipped segment of the second member is rotatably insertable through the gap. Advantageously, a plurality of such biasing means are spaced along the first member of each pair.

Preferably, the channel in the first member of each pair is sized to permit slidable displacement of the first and second members of each pair relative to one another of at least one inch. Locking means are provided for lockably interconnecting the header first member with the hinge and strike jamb first members, thereby facilitating factory prehanging of a door on the assembled door frame.

DETAILED DESCRIPTION OF THE PREFERRED EMBODIMENT

Figure 1A:
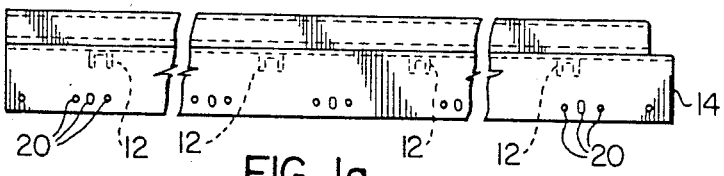
FIGS. 1*a*, 1*b* and 1*c* are, respectively, front, side and end views of a door frame strike jamb first member according to the invention.
Figure 1B:
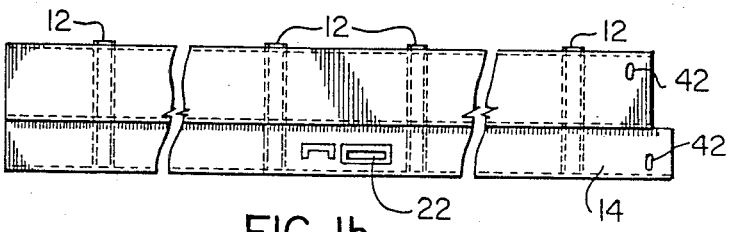

The drawings illustrate a pre-manufactured metal door frame having three major or parts; namely, a strike jamb, a hinge jamb and a header. Each of the three parts comprises two separate members. FIG. 1 illustrates the first member of the strike jamb, FIG. 2 illustrates the first member of the hinge jamb and FIGS. 3*a*, 3*c* and 3*d* illustrate the first member of the header. FIG. 4 llustrates a second member which may be used with either the first strike jamb member depicted in FIG. 1 or the first hinge jamb member depicted in FIG 2. FIG. 3*b* illustrates a header second member for use with the header first member depicted in FIGS. 3*a*, 3*c* and 3*d*.

Figure 1C:
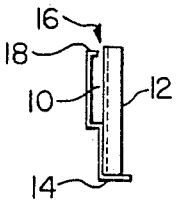
Figure 2A:
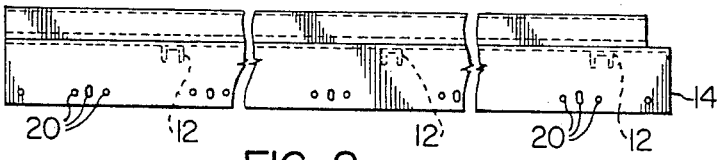
FIGS. 2*a*, 2*b* and 2*c* are, respectively, front, side and end views of a door frame hinge jamb first member according to the invention.
Figure 2B:
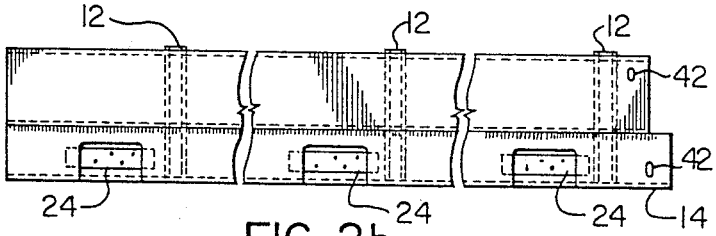
Figure 2C:
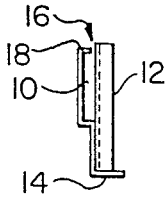
Figure 3A:
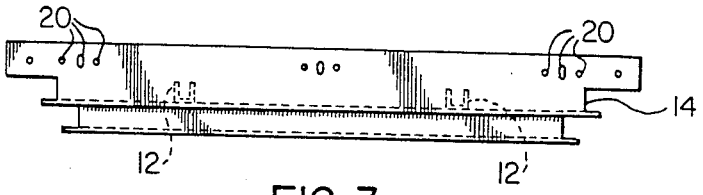
FIGS. 3*a*, 3*c* and 3*d* are, respectively, front, side and end views of a door frame header first member according to the invention; and, FIG. 3*b* is a front view of a door frame header second member engageable with the door frame header first member aforesaid.
Figure 3B:
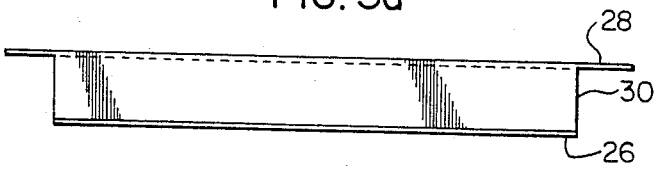
Figure 3C:
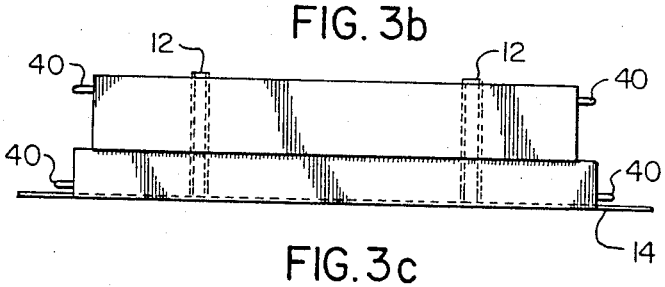
Figure 3D:
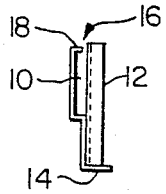

The door frame strike jamb, hinge jamb and header first members are of similar construction in that they each incorporate a channel 10 (best seen in FIGS. 1*c*, 2*c* and 3*d* respectively). In this application, like reference numerals are used to refer to features of the various door frame members which are common to each of the members. As may be seen, channel 10 is formed by providing a sguare "U" shaped bend which extends along one edge of each of the strike jamb, hinge jamb and header first members.

The strike jamb, hinge jamb and header first members are each provided with a plurality of biasing members 12 spaced uniformly along each such member. Each of biasing members 12 is rigidly affixed to the outer flange 14 of the respective strike jamb, hinge amb and header first members. As best seen in FIGS. 1*c*, 2*c* and 3*d* respectively, biasing members 12 extend across channel 10 of each of the first members, leaving a small gap 16 between biasing member 12 and the lipped cover 18 provided at the end of each of channels 10.

Each of the strike jamb, hinge jamb and header jamb first members are provided with a plurality of apertures 20 through which screws, nails or other suitable fasteners may be inserted to attach th door frame first members on one side of a door frame aperture. As best seen in FIG. 1*b*, the strike jamb first member includes a lock strike plate 22. As best seen in FIG. 2*b*, the hinge jamb first member includes a plurality of pre-drilled, recessed and reinforced apertures 24 for receiving a conventional door hinge.

Figure 4A:
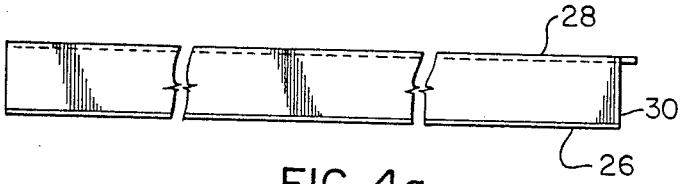
FIGS. 4*a* and 4*b* are, respectively, front and end views of a door frame second member which is engageable with the strike and hinge jamb members of FIGS. 1 and 2.
Figure 4B:
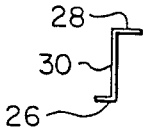

Reference is now made to the door frame hinge and strike jamb second member illustrated in FIGS. 4*a* and 4*b* and to the door frame header second member illustrated in FIG. 3*b*. Here again, like reference numerals are used to refer to features of each of the door frame second members which are common to those members. Each of the second members has a lipped inner segment 26 and an outer flange 28, each of which projects in opposite directions and at right angles from the opposed edges of an interior segment 30.

Figure 5A:
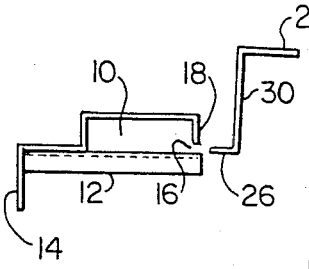
FIGS. 5*a*, 5*b and* 5*c* illustrate the manner in which the two members comprising the door frame strike jamb, hinge jamb and header are engageable with one another.
Figure 5B:
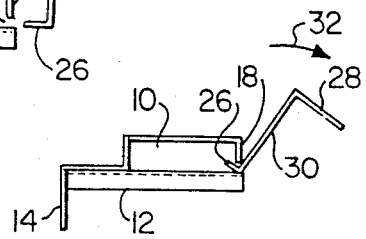

In operation, the strike jamb, hinge jamb and header first members are fitted into position on the side of the door aperture in which the door is to be hung. Screws, nails or other suitable fasteners are passed through apertures 20 in each of the first members to secure them in place. Three separate door frame second members (two of which correspond to that illustrated in FIG. 4 and one of which corresponds to that illustrated in FIG. 3*b*) are then positioned from the opposite side of the door aperture in the manner illustrated in FIG. 5. As depicted in FIG. 5*a*, lipped segment 26 of the door frame second member is initially slidably advanced through gap 16 between biasing member 12 and lipped cover 18 of the door frame first member. Once interior segment 30 of the second member is closely proximate lipped cover 18 of the first member, the second member is rotated through 90° in the direction of arrow 32 shown in FIG. 5*b*. This leaves the first and second members interlocked with one another in the positions illustrated in full outline in FIG. 5*c*, without the need for any connection between the first and second members. It will be be noted that lipped cover 18 of the door frame first member engages lipped segment 26 of the door frame second member to limit longitudinal movement of the two members relative to one another and thus prevent their separation; again, without the need for any connection between the two members. It will also be noted that biasing member 12 urges interior segment 30 of the door frame second member against the projecting edge of lipped cover 18 of the door frame first member. In practice, the door frame first member is constructed so that the projecting edge of lipped cover 18 rests against the side of biasing member 12, thus enhancing the spring biasing action which urges the door frame first and second members against one another.

Figure 5C:
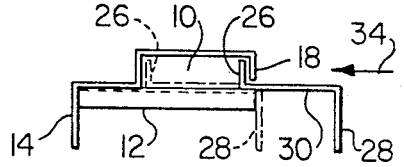

Once the door frame second member has been positioned as depicted in FIG. 5*c* it may be slidably advanced, in the direction of arrow 34, toward the fixed first door frame member to assume any position intermediate the positions illustrated in full and dotted outline in FIG. 5*c*. Those skilled in the art will appreciate that channel 10 may be sized to permit slidable displacement of the first and second members relative to one another of about two and one quarter inches, thus facilitating construction of door frames which can be adjusted to fit walls of widely varying thicknesses.

Figure 6:
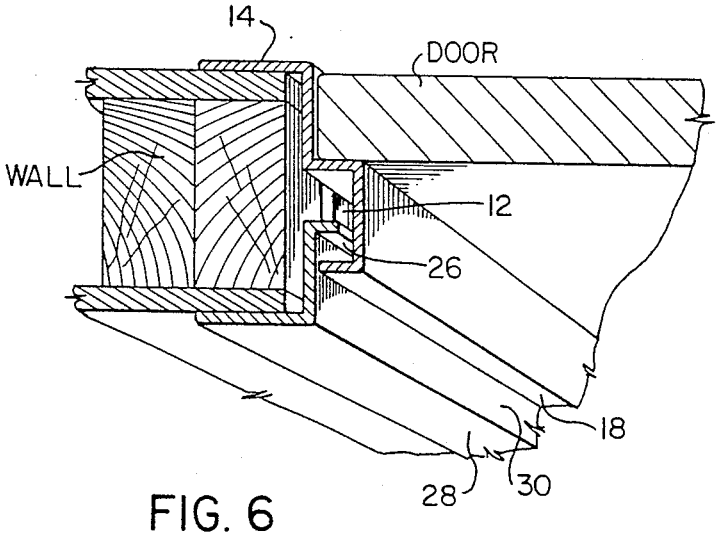
FIG. 6 is an oblique top end section view showing a portion of a door and a portion of a wall to which a door frame has been affixed in accordance with the invention.

FIG. 6 is an oblique pictorial end sectional illustration showing how the door frame first and second strike or hinge jamb members engage one another when the outer flanges 14, 28 of each member are fastened flush against opposed sides of the wall. It will be seen that channel 10 affords an extremely wide range of adjustability relative to prior art expandable door frames, without sacrificing any measure of rigidity in the finished door frame.

A significant advantage of the preferred embodiment is that it may be factory assembled and prehung with a door, thus ensuring rapid construction of accurately fitted doors and door frames. More particularly, the header first member is provided with "locking means"; namely, locking tabs 40 which are received through cooperating apertures 42 in the upper ends of each of the strike and hinge jamb first members (see FIGS. 1*b*, 2*b* and 3*c*). Once tabs 40 have been passed through apertures 42, the tabs are bent at right angles to the header first member to lockably interconnect the header first member to the strike and hinge jamb first members and hold them firmly in position relative to one another. A sill (not shown) or a temporary brace member aay similarly be fitted in position between the bottom ends of the strike and hinge jamb first members. A door can then be hung on the assembled first members in conventional fashion and temporarily fastened in the closed position to prevent movement thereof during shipping. The header, strike and hinge jamb second members can also be slidably engaged with their respective first members, after which the assembled frame and door is ready for shipping. At the job site, the header, strike and hinge jamb second members are removed; the assembled header, strike and hinge jamb first members, together with the door, are inserted into the door aperture, fastened in place and the second members are then replaced as aforesaid.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A door frame, comprising:

(a) a hinge jamb comprising first and second hinge jamb members;

(b) a strike jamb comprising first and second strike jamb members; and, (c) a header comprising first and second header members; wherein:

(d) said hinge jamb first member comprises a channel for slidably receiving a lipped segment of said hinge jamb second member, said hinge jamb first member channel having a lipped cover for engaging said hinge jamb second member lipped segment to limit movement of said hinge jamb members relative to one another without connection between said hinge jamb members;

(e) said strike jamb first member comprises a channel for slidably receiving a lipped segment of said strike jamb second member, said strike jamb first member channel having a lipped cover for engaging said strike jamb second member lipped segment to limit movement of said strike jamb members relative to one another without connection between said strike jamb members; and, (f) said header first member comprises a channel for slidably receiving a lipped segment of said header second member, said header first member channel having a liped cover for engaging said header second member lipped segment to limit movement of said header members relative to one another without connection between said header members.

2. A door frame as described in claim 1, wherein:

(a) said hinge jamb first member further comprises biasing means for urging said hinge jamb first and second members against one another;

(b) said strike jamb first member further comprises biasing means for urging said strike jamb first and second members agaisnt one another; and, (c) said header first member further comprises biasing means for urging said header first and second members against one another.

3. A door frame as described in claim 2, wherein:

(a) said hinge jamb biasing means comprises a third member rigidly affixed to said hinge jamb first member and extending across said hinge jamb first member channel to leave a small gap between said hinge jamb third member and said hinge jamb first member cover for rotatable insertion therethrough of said hinge jamb second member lipped segment;

(b) said strike jamb biasing means comprises a third member rigidly affixed to said strike jamb first member and extending across said strike jamb first member channel to leave a small gap between said strike jamb third member and said strike jamb first member cover for rotatale insertion therethrough of said strike jamb second member lipped segment;

(c) said header biasing means comprises a third member rigidly affixed to said header first member and extending across said header first member channel to leave a small gap between said header third member and said header first member cover for rotatable insertion therethrough of said header second member lipped segment.

4. A door frame as described in claim 3, wherein:

(a) said hinge jamb biasing means comprises a plurality of said hinge jamb third members spaced along said hinge jamb first member;

(b) said strike jamb biasing means comprises a plurality of said strike jamb third members spaced along said strike jamb first member; and, (c) said header biasing means comprises a plurality of said header third members spaced along said header first member.

5. A door frame as described in claim 3, further comprising locking means for lockably interconnecting said header first member with said hinge jamb first member and with said strike jamb first member.

6. A door frame as described in claim 1, wherein:

said hinge jamb first member channel is sized to permit slidable displacement of first and second members relative to one another of about two and one quarter inches;

(b) said strike jamb first member channel is sized to permit slidable displacement of first and second members relative to one another of about two and one quarter inches; and, (c) said header first member channel is sized to permit slidable displacement of first and second members relative to one another of about two and one quarter inches.

* * * * *